US005262816A

United States Patent [19]

Samuels et al.

[11] Patent Number: 5,262,816

[45] Date of Patent: Nov. 16, 1993

[54] CONTROL OF TEMPERATURE IN FILM PROCESSOR IN ABSENCE OF VALID FEEDBACK TEMPERATURE DATA

[75] Inventors: James T. Samuels, Rochester; Michael Newman, Pittsford, both of N.Y.

[73] Assignee: Eastman Kodak Company, Rochester, N.Y.

[21] Appl. No.: 759,485

[22] Filed: Sep. 13, 1991

Related U.S. Application Data

[63] Continuation-in-part of Ser. No. 738,664, Jul. 31, 1991, Pat. No. 5,255,370, which is a continuation-in-part of Ser. No. 495,867, Mar. 19, 1990, Pat. No. 5,065,173, which is a continuation-in-part of Ser. No. 494,647, Mar. 16, 1990, Pat. No. 4,994,837.

[51] Int. Cl.[5] ..... G03D 3/08

[52] U.S. Cl. ..... 354/299; 354/322; 34/31; 34/48

[58] Field of Search ..... 354/299, 322, 324; 34/30, 31, 46, 48, 155

[56] References Cited

U.S. PATENT DOCUMENTS

| | | | |
|---|---|---|---|
| 4,057,817 | 11/1977 | Korb et al. | 354/298 |
| 4,160,153 | 7/1979 | Melander | 354/299 X |
| 4,182,567 | 1/1980 | Laar et al. | 354/299 |
| 4,300,828 | 11/1981 | Kaufmann | 354/322 |
| 4,316,663 | 2/1982 | Fischer | 354/299 |
| 4,332,456 | 6/1982 | Kaufmann | 354/299 X |
| 4,914,835 | 4/1990 | Kose et al. | 34/31 |
| 4,952,960 | 8/1990 | Kosugi et al. | 354/299 |
| 4,985,720 | 1/1991 | Masuda et al. | 354/299 |
| 4,994,837 | 2/1981 | Samuels et al. | 354/299 |
| 5,065,173 | 11/1991 | Samuels et al. | 354/298 |
| 5,127,465 | 7/1992 | Fischer | 354/299 X |

OTHER PUBLICATIONS

Kenneth W. Oemcke, "Ambient Water Thermal Control System," Dept. of Mechanical Engineering, Rochester, N.Y., Jul. 1978.

*Primary Examiner*—A. A. Mathews

*Attorney, Agent, or Firm*—Warren Locke Franz

[57] ABSTRACT

A temperature control system (10) of an automatic film processor (12) includes developer and fixer recirculation paths (30, 40) having thermowell heaters (34, 44) and thermistors (35, 45), and a cooling heat exchanger (37) in the developer path (30) which passes in heat exchange relationship with water in a wash tank (23). The system (10) also has a blower (48), heater (49) and thermistor (52) in an air path of a dryer (24). Heater (34, 44, 49) and cooling heat exchanger (37) operation is normally controlled on a closed loop, feedback mode basis by comparing measured current temperatures in real time with preestablished setpoint temperatures. When system errors cause an absence of current valid measured temperature data, shutdown or lockout can be overridden, and temperature control continued on an open loop basis using stored historical measurement data and on-off duty cycle profiles.

15 Claims, 9 Drawing Sheets

CONTROL OF TEMPERATURE IN FILM PROCESSOR IN ABSENCE OF VALID FEEDBACK TEMPERATURE DATA

This is a continuation-in-part of U.S. patent application Ser. No. 07/738,664, filed Jul. 31, 1991, now U.S. Pat. No. 5,235,370, entitled "Method and Apparatus for Out-of-Rate Error Detection In Film Processor Temperature Control System" which is a continuation-in-part of U.S. patent application Ser. No. 07/495,867, filed Mar. 19, 1990, entitled "Processor With Speed Independent Fixed Film Spacing," now U.S. Pat. No. 5,065,173 which is a continuation-in-part of U.S. patent application Ser. No. 07/494,647, filed Mar. 16, 1990, entitled "Processor With Temperature Responsive Film Transport Lockout" (now U.S. Pat. No. 4,994,837). This application deals with subject matter similar to that of U.S. patent applications Ser. No. 07/759,484, entitled "Method for Detecting Non-Valid States in Film Processor Temperature Control System," and Ser. No,. 07/759,454, entitled "Modification of FIlm Processor Chemistry Proportional Heating During Replenishment," filed on even date herewith, the disclosure ofwhich are incorporated herein by reference

TECHNICAL FIELD

The present invention relates to processors of film and similar photosensitive media, in general; and, in particular, to a method for controlling the temperature of chemicals in such a processor in the absence of valid measured temperature data.

BACKGROUND ART

Photosensitive media processors, such as Kodak X-OMAT processors, are useful in applications like the automatic processing of radiographic films for medical imaging purposes. The processors automatically transport sheets or rolls of photosensitive film, paper or the like (hereafter "film") from a feed end of a film transport path, through a sequence of chemical processing tanks in which the film is developed, fixed, and washed, and then through a dryer to a discharge or receiving end. The processor typically has a fixed film path length, so final image quality depends on factors including the composition and temperature of the processing chemicals (the processor "chemistry"), and the film transport speed (which determines the length of time the film is in contact with the chemistry).

In a typical automatic processor of the type to which the invention relates, film transport speed is set at a constant rate and the chemistry is defined according to a preset recommended temperature, e.g. 94° F. (34° C.), with a specified tolerance range of ±X°. A temperature control system, responsive to feedback data indicative of sensed actual chemistry temperature, is provided to keep the chemicals within the specified range.

Some processors use a thermowell located in a developer recirculation path to maintain a desired recommended developer chemical temperature. The thermowell has a cartridge heater inserted into one end of a hollow tubular body through which the developer is caused to flow by means of a pump. A thermistor protruding into the thermowell flow path serves to monitor the recirculating developer temperature. The duty cycle of the heater is varied, based upon data received from the thermistor, as a function of the proximity of the measured actual temperature to a preestablished developer setpoint temperature. Until the setpoint temperature is reached, a "wait" light or similar annunciator signals the user that an undertemperature condition exists. Once the setpoint temperature is reached, heating and cooling cycles are initiated, as needed, in accordance with detected temperature variations from the setpoint. Cooling may be accomplished by operation of a solenoid valve which redirects the developer through a loop in the recirculation path which is in heat exchange relationship with cooler water in the wash tank. The fixer, whose temperature is less critical, may have its own thermowell recirculation path or may be maintained at a temperature close to the developer temperature by directing it in heat exchange relationship with the developer.

Processors have been introduced which are settable as to transport speed and temperature, so the same processor can be used for multiple processing modes. A particular mode is often referred to by a shorthand designation indicative of its associated "drop time," which corresponds to the time lapse from entry of the leading edge of a film at the feed end of the processor, until exit of the trailing edge of the same film at the discharge end. Kodak uses the designations "Kwik" or "K/RA," "Rapid," "Standard," and "Extended" to refer to different user-selectable operating modes, each of which has its own characteristic transport speed and developer setpoint temperature.

The operations and functions of automatic film processors are handled under control of electronic circuitry, including a microprocessor connected to various process sensors and subsidiary controls to receive and dispense electronic signals in accordance with predefined software program instructions. Examples of such control circuitry are shown in U.S. Pat. Nos. 4,300,828 and 4,994,837, the disclosures of both of which are incorporated herein by reference.

If film is run through a processor at system start-up or during a change of mode, before the chemistry temperature has reached the designated setpoint setting for the selected mode, the image development may well be of substandard quality and, in worst case, not readable at all. For diagnostic imaging, this may necessitate retake with consequential patient inconvenience and additional radiation exposure. In cases of radiographic imaging utilized for progress monitoring purposes during a surgical operating procedure, this may lead to other undesirable consequences. It is, therefore, desirable to be able to prevent processing of exposed photosensitive media until setpoint temperatures are reached. This may be accomplished by configuring the temperature control circuitry to indicate a "ready" condition only when the developer, and optionally the fixer, chemicals reach their desired operating temperatures (i.e, until they are within X. of their setpoint temperatures). U.S. Pat. No. 4,994,837 describes a system whereby the film drive transport mechanism is disabled to prevent the introduction of fresh film, until desired chemical temperatures are attained.

It is also desirable to be able to indicate a failure of the feedback operation of the temperature control system. This occurs either when actual processor temperatures cannot be measured at all, or when measured temperature data exists but is invalid.

U.S. patent application Ser. No. 07/738,664, entitled "Method and Apparatus for Out-of-Rate, Error Detection In Film Processor Temperature Control System," filed Jul. 31, 1991, describes a processor temperature control system in which malfunctions in operation of heating and cooling cycles are determined utilizing comparisons of actual and normal rates of change in chemical or dryer air temperature over time. Failures are indicated based on comparisons of time variations in measured actual temperatures for a given heating (or cooling) cycle, with expected variations for the same cycle assuming normal rates of heating (or cooling) under normal temperature control system operating conditions. If the actual rate of measured temperature increase (or decrease) deviates by more than a preestablished acceptable tolerance from the expected normal rate of increase (or decrease), an error is indicated. The system can be set to shut down the processor or disable the film drive transport mechanism (with user-controllable override) to prevent the introduction of fresh film, if the error is not corrected. Such rate error detection scheme enables the rapid determination of temperature control system malfunction, prior to attainment of setpoint temperatures and flags errors which conventional error detection means would miss. The disclosure of that application is incorporated herein by reference.

U.S. patent application Ser. No. 07/759,484, entitled "Method for Detecting Non-Valid States In Film Processor Temperature Control System," filed on even date herewith, describes a method for verifying the validity of temperature measurement data based on comparisons of the measured actual temperatures with predications as to what valid actual temperature states could be, given the heat gains (or losses) applied in the system during the time interval between measurements. If a measured actual temperature deviates randomly from a corresponding predicted temperature by more than a predetermined tolerance factor, that measurement is disregarded for control and error diagnosis purposes. When deviations persist, an error is signalled and the system is shut down or otherwise disabled. The disclosure of that application is also incorporated herein by reference.

Whether an error occurs because of complete loss of temperature measurement ability, or because data that is generated is not valid, normal temperature control functioning which depends on such feedback information will be adversely affected. If valid measured temperature data needed for feedback continues to be absent, meaningful temperature control decisions cannot be made and conventional closed loop temperature control systems will fail, leading to lockout or shutdown. There are circumstances, however, when it is desirable to be able to override such lockout or shutdown, and to be able to continue to provide at least a measure of meaningful temperature control on an open loop basis.

DISCLOSURE OF THE INVENTION

It is an object of the present invention to provide a method for controlling temperature in an automatic film processor in the absence of valid measured temperature data usable for feedback.

In accordance with the invention, a system for controlling the temperature of chemicals or dryer air in an automatic film processor includes means for generating data corresponding to the measurement of actual temperatures of the chemicals or air occurring at successive times; means for regulating the temperature of the chemicals or air in response to the actual temperature measurement data; means for determining the absence of valid measured temperature data; and means for regulating the temperature of the chemicals or air in the absence of valid measured temperature data.

An embodiment of the invention, described in greater detail below, is employed with a general purpose radiographic film processor having means for automatically transporting film through developer, fixer, wash and dryer stations according to a selected one of a plurality of available film processing modes, each having an associated characteristic film transport speed and developer setpoint temperature. Data corresponding to measured actual developer temperatures occurring at successive times is generated for feedback control under microprocessor supervision, based on measurements taken at periodic time intervals by a temperature sensor in contact with developer flowing in a recirculation path. Historical profiles actual temperature/time measurements taken under normal control system functioning are stored in correlation with each operational mode, and periodically updated. Alternatively, or in addition, historical profiles of on-off duty cycles of heater (cooler) operation for maintaining setpoint temperatures at equilibrium under normal functioning are stored. Determinations are made to identify failures in the generation of valid measured temperature data which may interfere with the continuing ability to reliably perform temperature control on a closed loop heating (or cooling) basis. And, when such failure is identified, open loop control based on the stored historical profiles is initiated. Similar open loop temperature control mechanisms are provided for fixer chemical and dryer air temperature control.

The method of the invention enables the continuation of temperature control function in an open loop mode, using heater/cooler duty cycles chosen on a preestablished criteria using stored historical information, when the absence of current valid temperature measurement data usable for feedback purposes precludes further meaningful control on a real time, closed loop mode basis.

BRIEF DESCRIPTION OF THE DRAWINGS

Embodiments of the invention have been chosen for purposes of illustration and description and are shown in the accompanying drawings, wherein.

Throughout the drawings, like elements are referred to by like numerals.

MODE OF CARRYING OUT THE INVENTION

Figure 2:
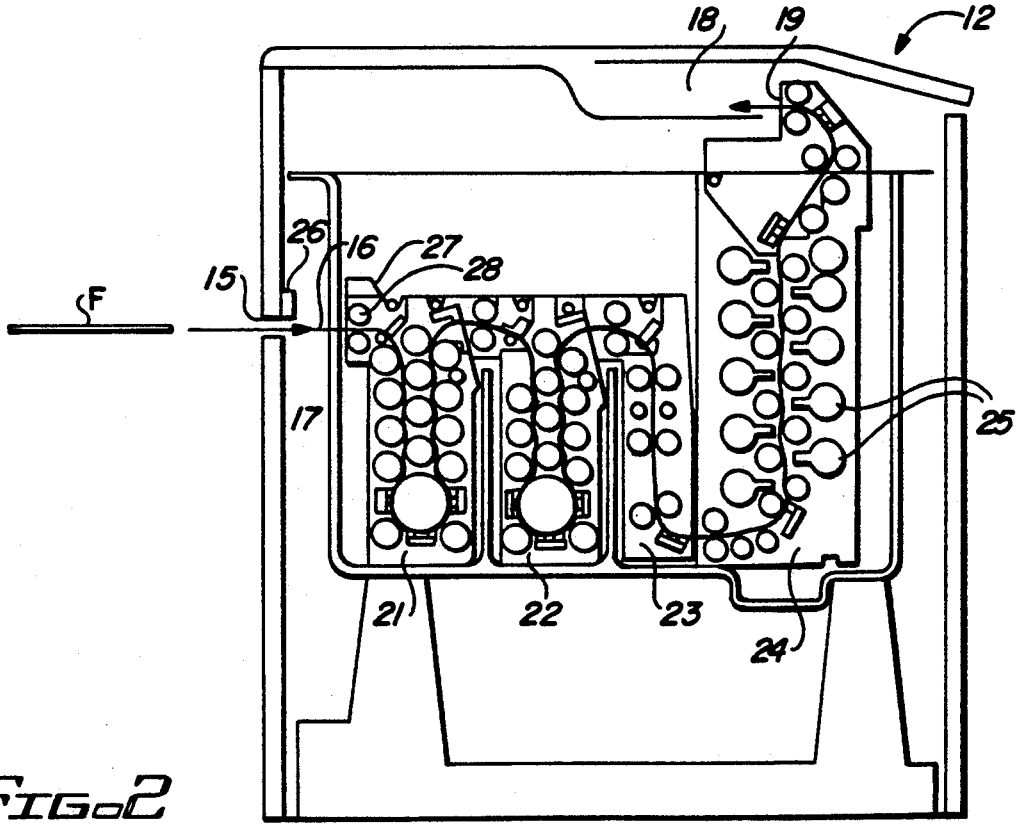
FIG. 2 is a schematic representation of relevant elements of the processor of FIG. 1.
Figure 3:
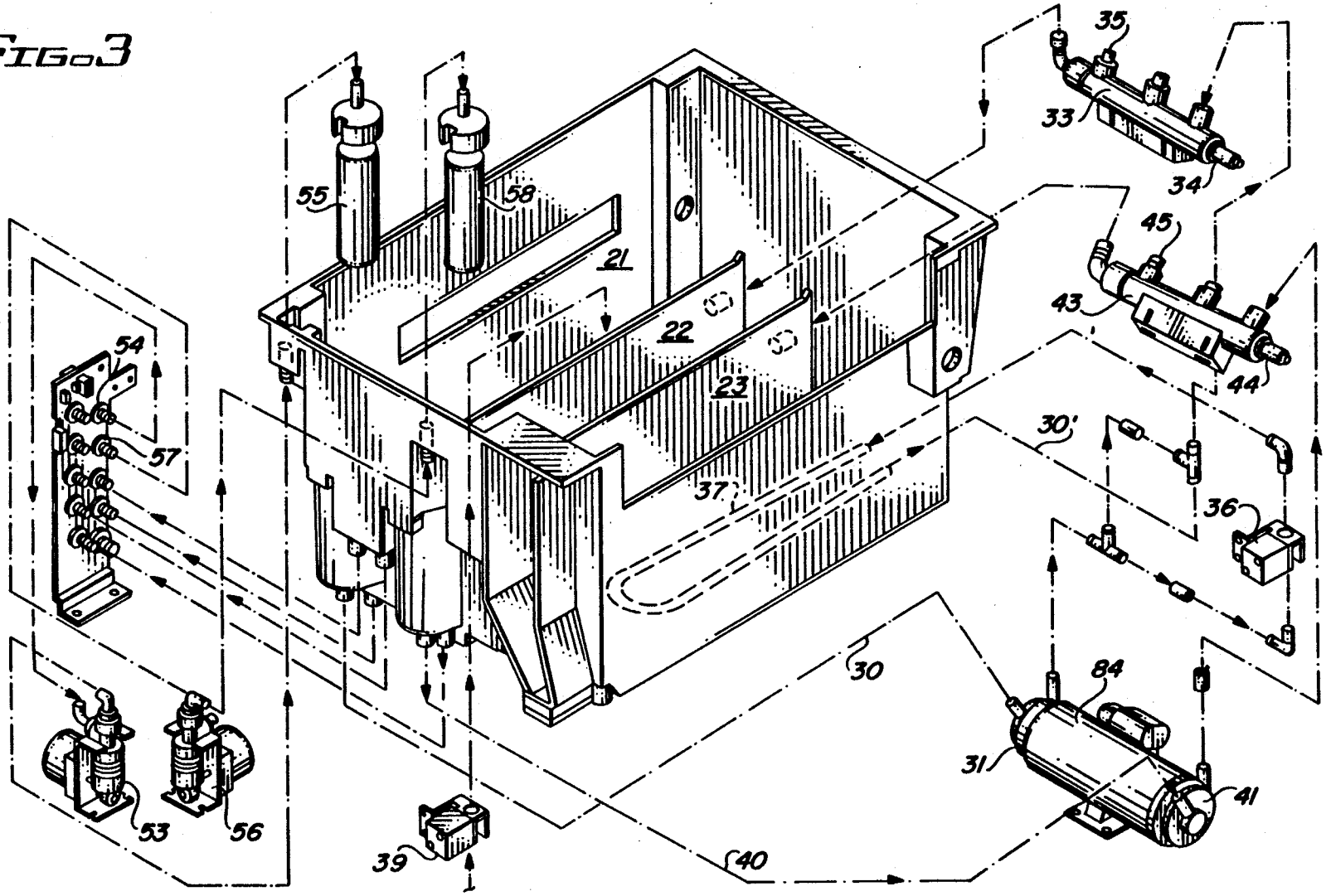
FIG. 3 is a schematic diagram showing the developer and fixer recirculation paths.

The principles of the invention are illustrated, by way of example, embodied in the form of a temperature control system 10 (FIGS. 3–4) suitable for use with a processor 12 (FIGS. 1 and 2) having four user-selectable film modes for the automatic processing of photosensitive film F (FIG. 2), such as for the development of radiographic images for medical diagnostic purposes. Associated with each mode are default parameters for transport speed; developer and fixer replenishment volumes; developer, fixer and dryer setpoint temperatures; and so forth. Such parameters are stored in memory, but can be modified through user input.

Figure 1:
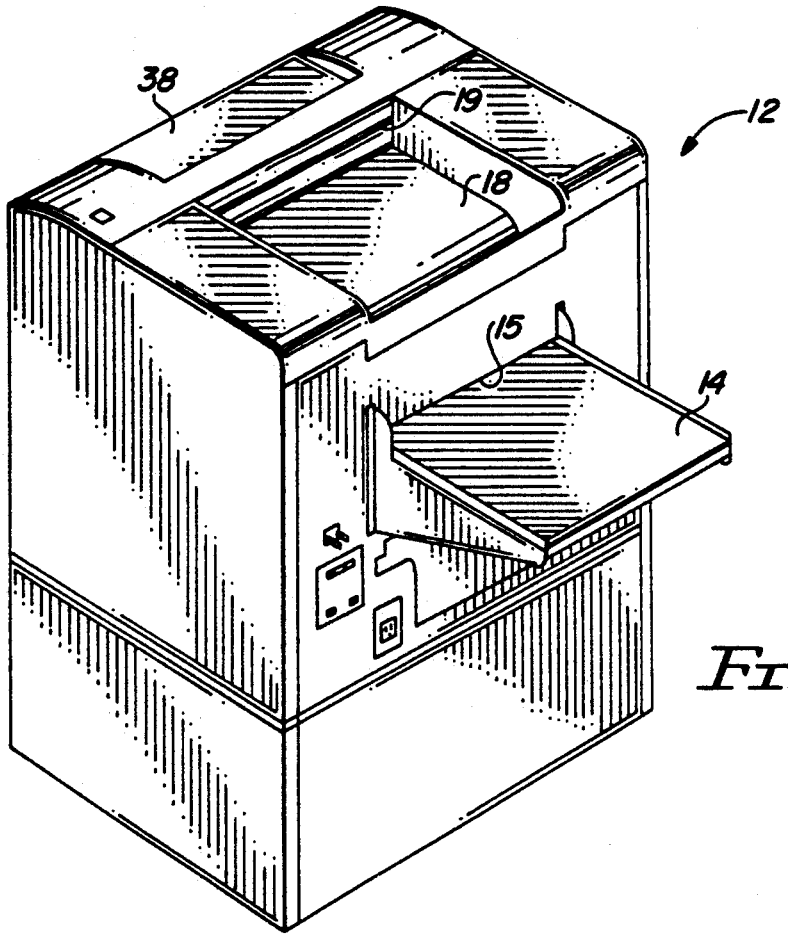
FIG. 1 is a perspective view of a processor in which a temperature control system incorporating the present invention can be employed.

The processor 12 has a feed tray 14 positioned ahead of an entrance opening 15 (FIG. 1). Patient film F (FIG. 2) entered through entrance opening 15 is transported through processor 12 along a travel path 16 (indicated by arrows in FIG. 2) by a network of conventional motor shaft-driven rollers 17, and eventually into a catch bin 18 at an exit opening 19. The path 16 includes travel through a developing station comprising a tank 21 filled with developer chemical; a fixing station comprising a tank 22 filled with fixer chemical; and a wash station comprising a tank 23 filled with wash water or comprising some other appropriate film washing device. Processor 12 also includes a drying station 24 comprising oppositely-disposed pluralities of air dispensing tubes 25 or other appropriate film drying mechanism.

Positioned proximate opening 15 is a sensor 26, such as a conventional reflective infrared LED sensor array, which provides a signal indicative of film width when film F is presented at the entrance opening 15. The film width sensor 26 also provides an indication of the occurrence of passage of the leading edge and trailing edge of film passing point 26 of the processor 12, since the signal from the sensor 26 will change significantly as each leading and trailing edge is encountered. A second sensor 27, in the form of a reed switch or the like, may be provided to detect separation of the entrance rollers 28 to signal the beginning of transportation of film F along the path 16.

The temperature of developer chemical in tank 21 may be controlled by means of a developer recirculation path 30 (shown in dot-dashed lines in FIG. 3) having a pump 31 for drawing developer out of tank 21, passing it through a thermowell 33 incorporating a heater 34 or other suitable heating device, and then passing it back to the tank 21. The path 30 also includes means for cooling the developer, such as a solenoid valve 36 which may be operated to redirect the developer through a loop 37 in heat exchange relationship with cooling water in water tank 23. The flow of water in tank 23 (see dot-dot-dashed lines in FIG. 3) is under control of a solenoid valve 39. A temperature sensor 35 (FIG. 4) is provided in the tank 21 or recirculation path 30 to monitor the temperature of the developer. The sensor 35 may, for example, be a thermocouple provided in the thermowell 33. Developer temperature may be displayed on a panel 38 (FIG. 1) located externally on the processor 12.

The temperature of fixer chemistry may be controlled in a similar manner by means of a fixer recirculation path 40 (shown in solid lines in FIG. 3) having a pump 41 for drawing fixer out of tank 22, passing it through a thermowell 43 incorporating a heater 44 or other suitable heating device, and then passing it back to the tank 22. A temperature sensor 45, such as a thermocouple similar to thermocouple 35, is provided in the tank 22 or recirculation path 40 to monitor the temperature of the fixer. Maintaining the setpoint temperature of the fixer is less critical than maintaining the setpoint temperature of the developer, so no cooling loop is provided.

The temperature of air in the dryer 24 can be maintained by energizing a blower motor 48 and air heater 49 (FIG. 4) to drive warm air through the tubes 25 (FIG. 2) and across the surface of film F. A temperature sensor 52, similar to thermocouple 35 or 45, may be located in the air path to monitor dryer air temperature. It will be appreciated that other ways of controlling processor chemistry and dryer temperatures may be employed.

Recirculation of developer and fixer takes place when the developer and fixer tanks 21, 22 are full. The "full" condition is detected by level sensing sensors 50, 51 (FIG. 4) located in communication with the tanks 21, 22. Developer and fixer replenishment occurs automatically if the level falls below a predefined desired level. This is accomplished for the developer by energizing a replenishment pump 53 (FIG. 3) connected at its input side to a supply of replenishment developer 54 and at its output side to a filter assembly 55 located in fluid communication with the developer tank 21. For the fixer, replenishment is similarly accomplished by energizing of a replenishment pump 56 connected at its input side to a supply of replenishment fixer 57 and at its output side to a filter assembly 58 located in fluid communication with the fixer tank 22.

The sensors 50, 51 may be of a type having one contact in the form of a probe exposed to the solution and another contact grounded to the case of the heater 34 or 44. The probe can be located to monitor solution level in the main tank 21 or 22 or in an associated level-sensing auxiliary reservoir. When the probe becomes immersed in solution, a path is provided to ground and the resistance of the sensor circuit is lowered. The value of the lowered resistance indicates the level of the solution.

Figure 4:
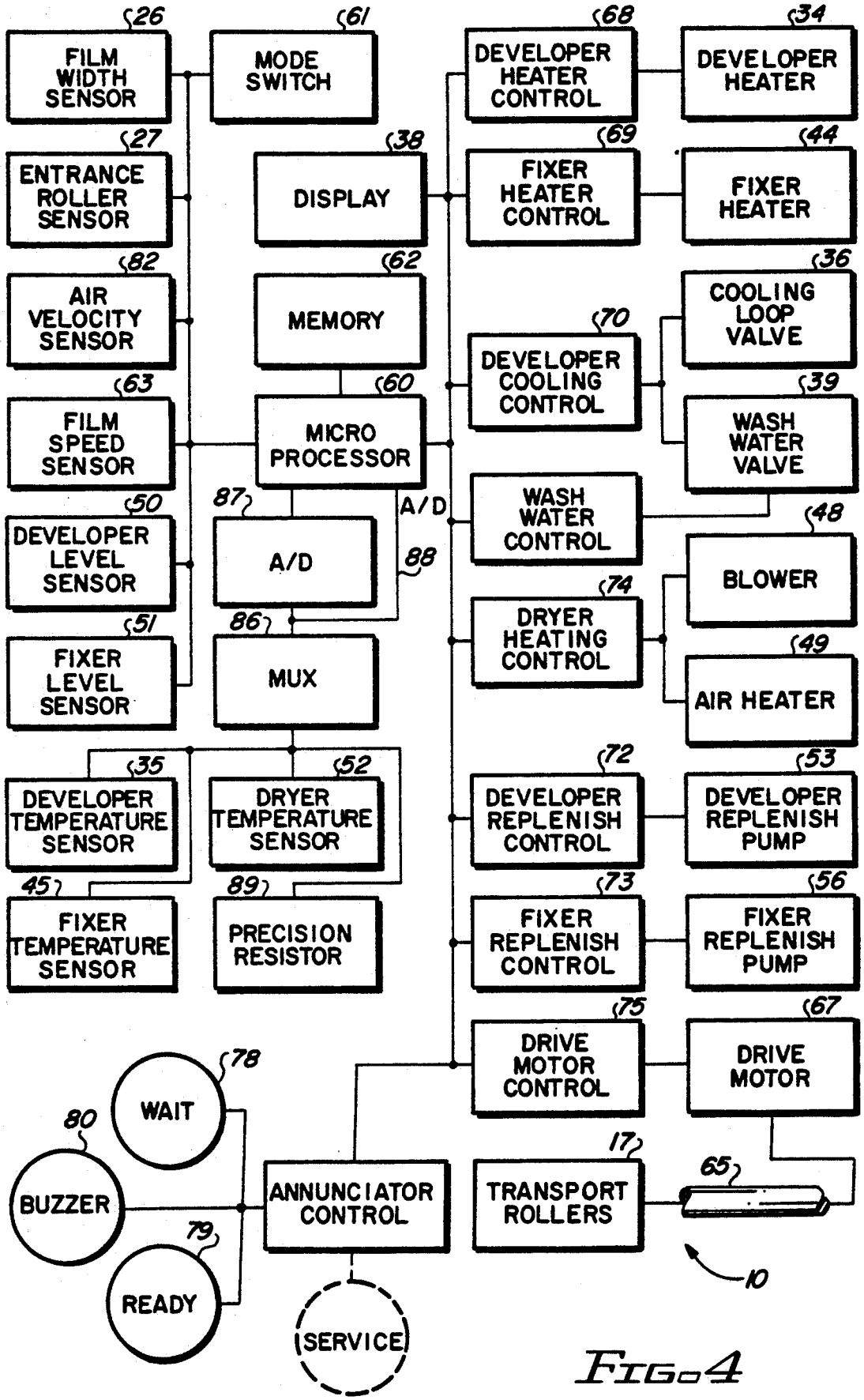
FIG. 4 is a block diagram of the control system employed in the processor.
Figure 5A:
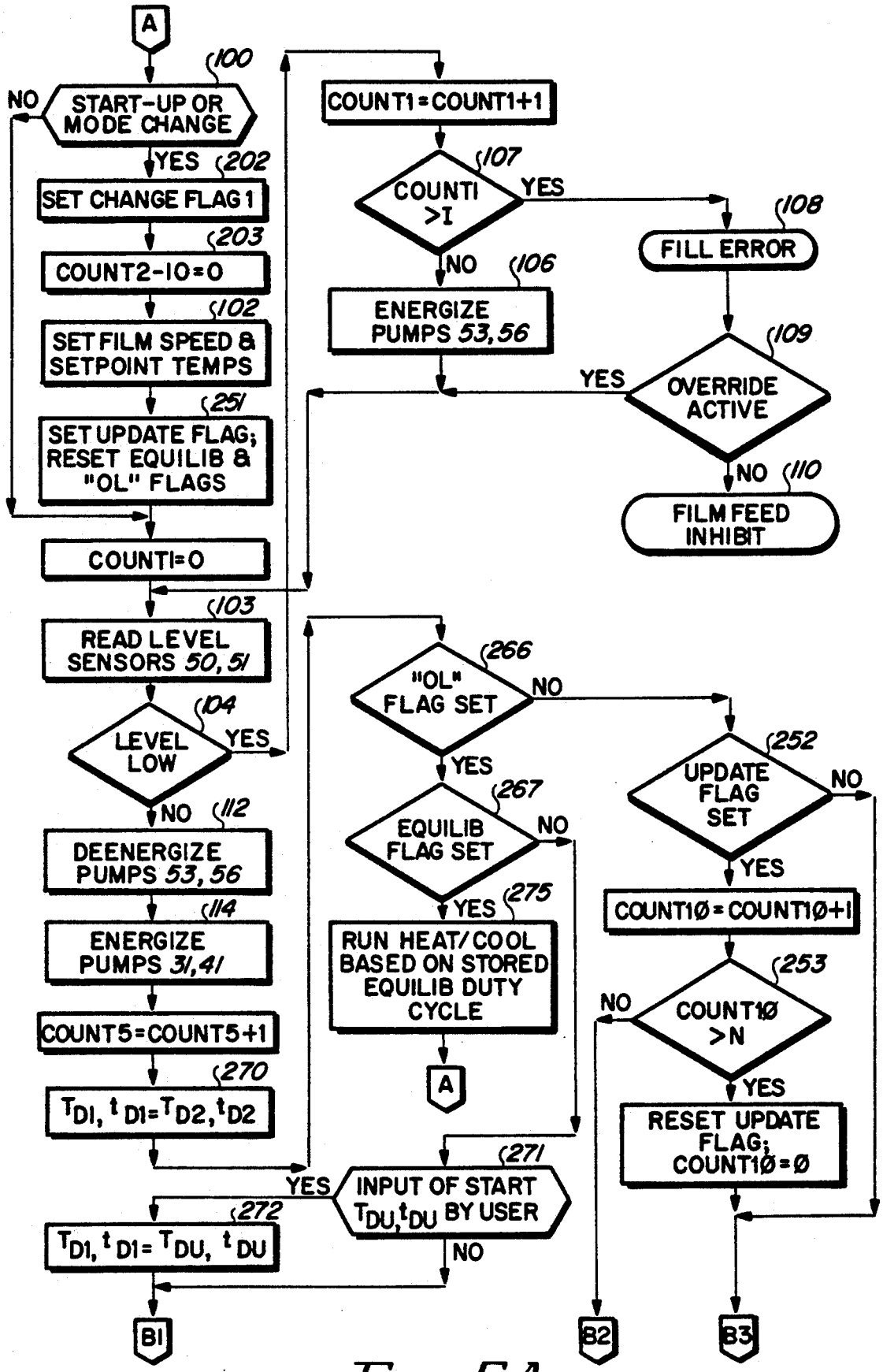
FIGS. 5A–5E (hereafter collectively referred to as FIG. 5) are respective portions of a single flow diagram of the operation of the system of FIG. 4.
Figure 5B:
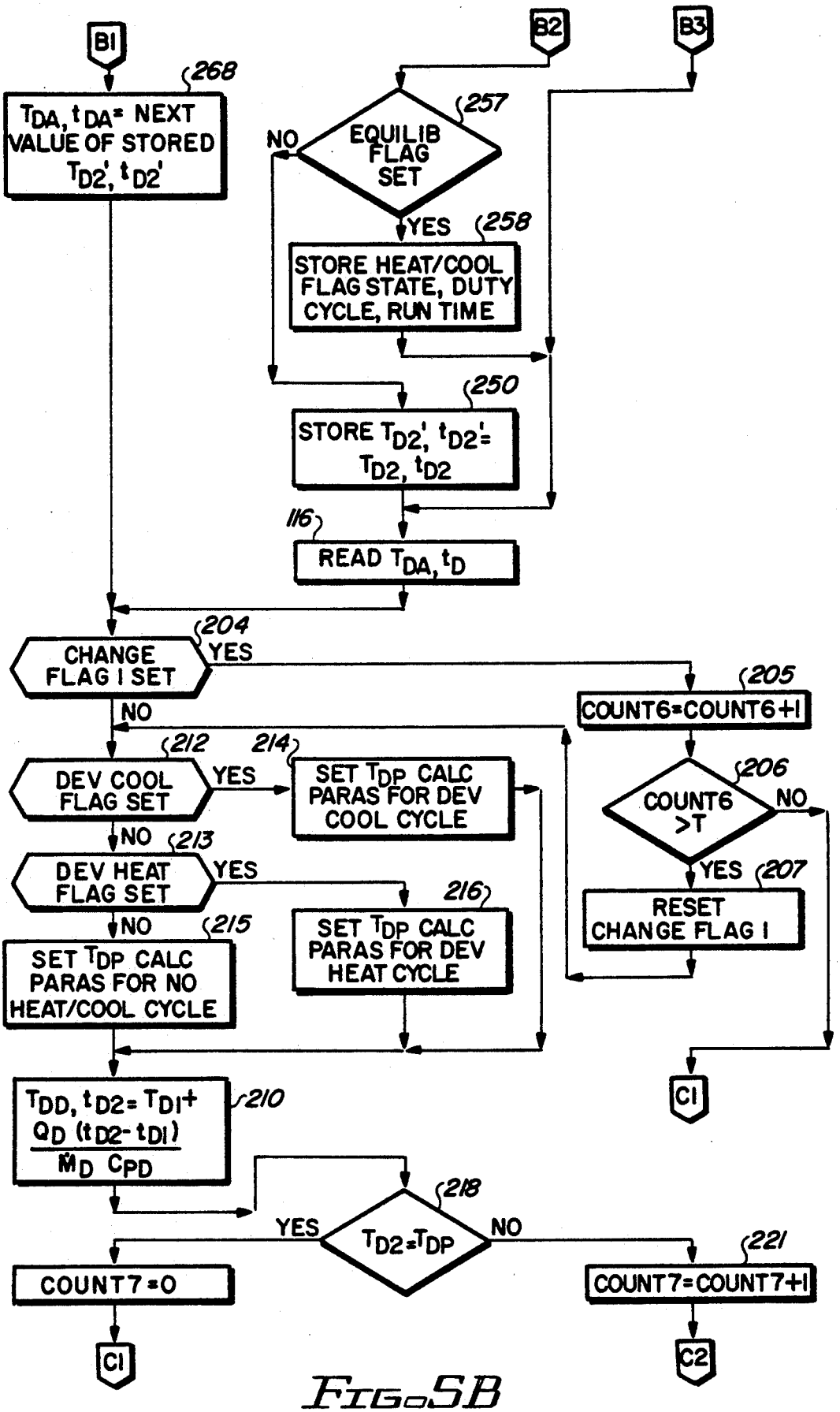
Figure 5C:
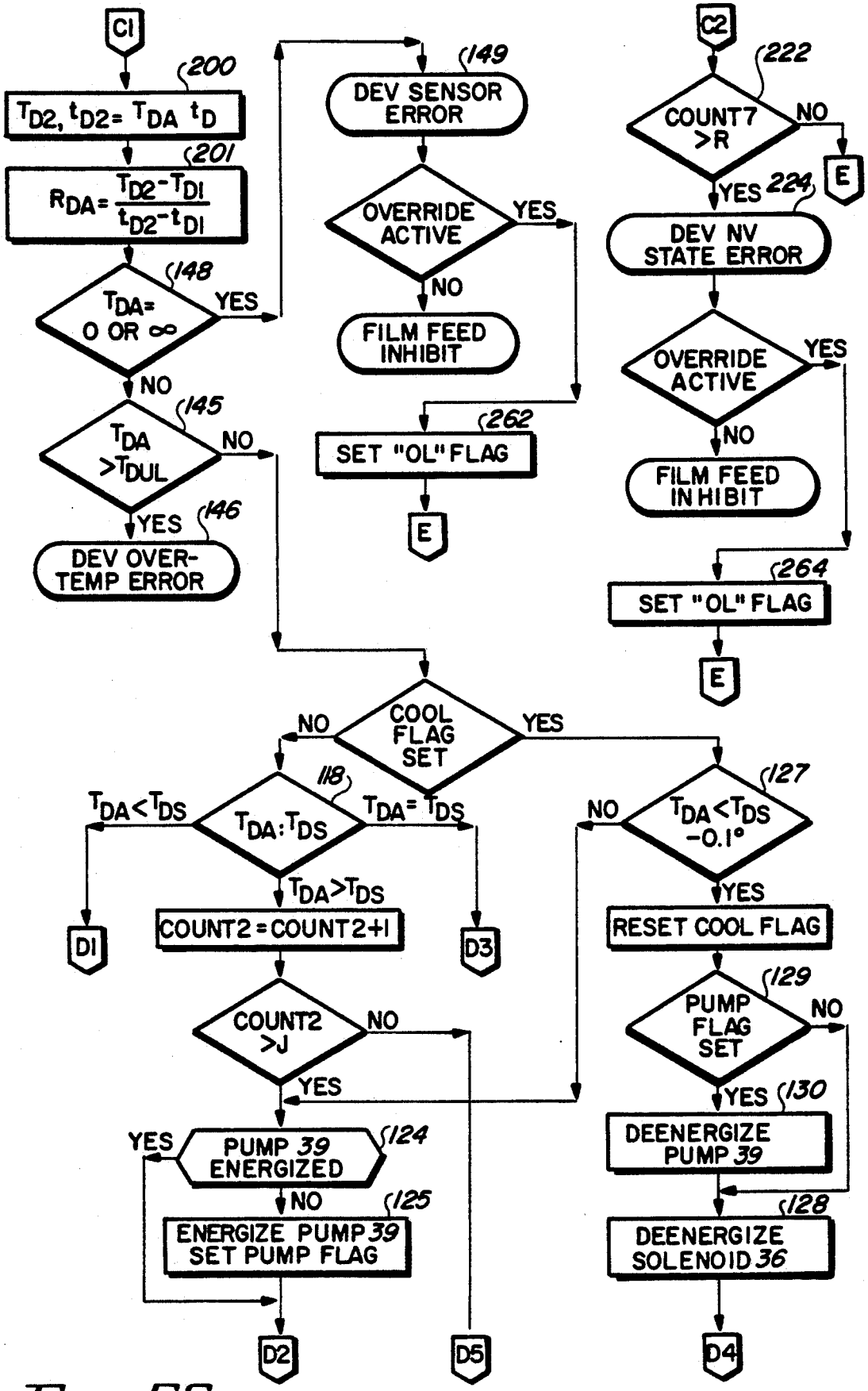
Figure 5D:
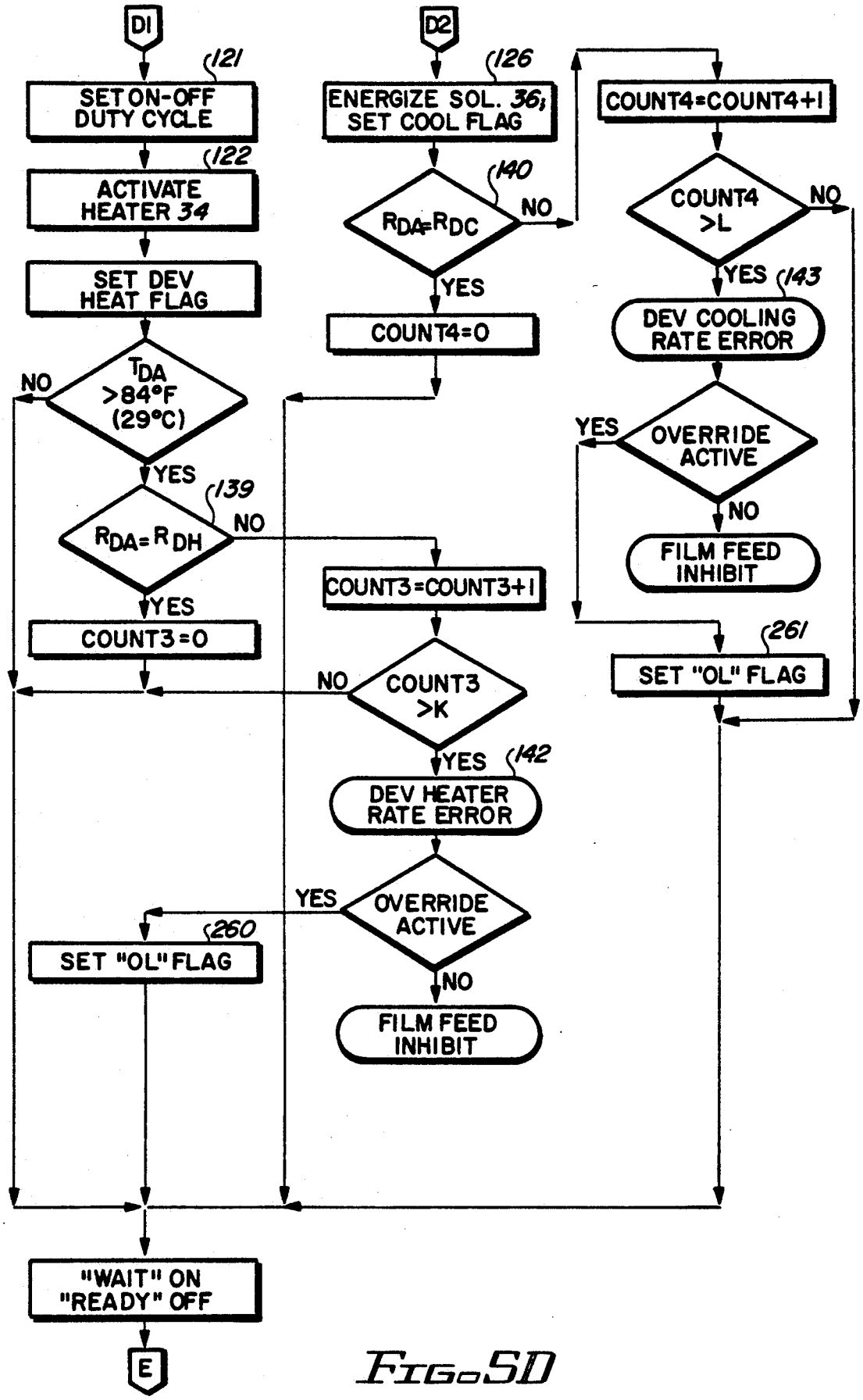
Figure 5E:
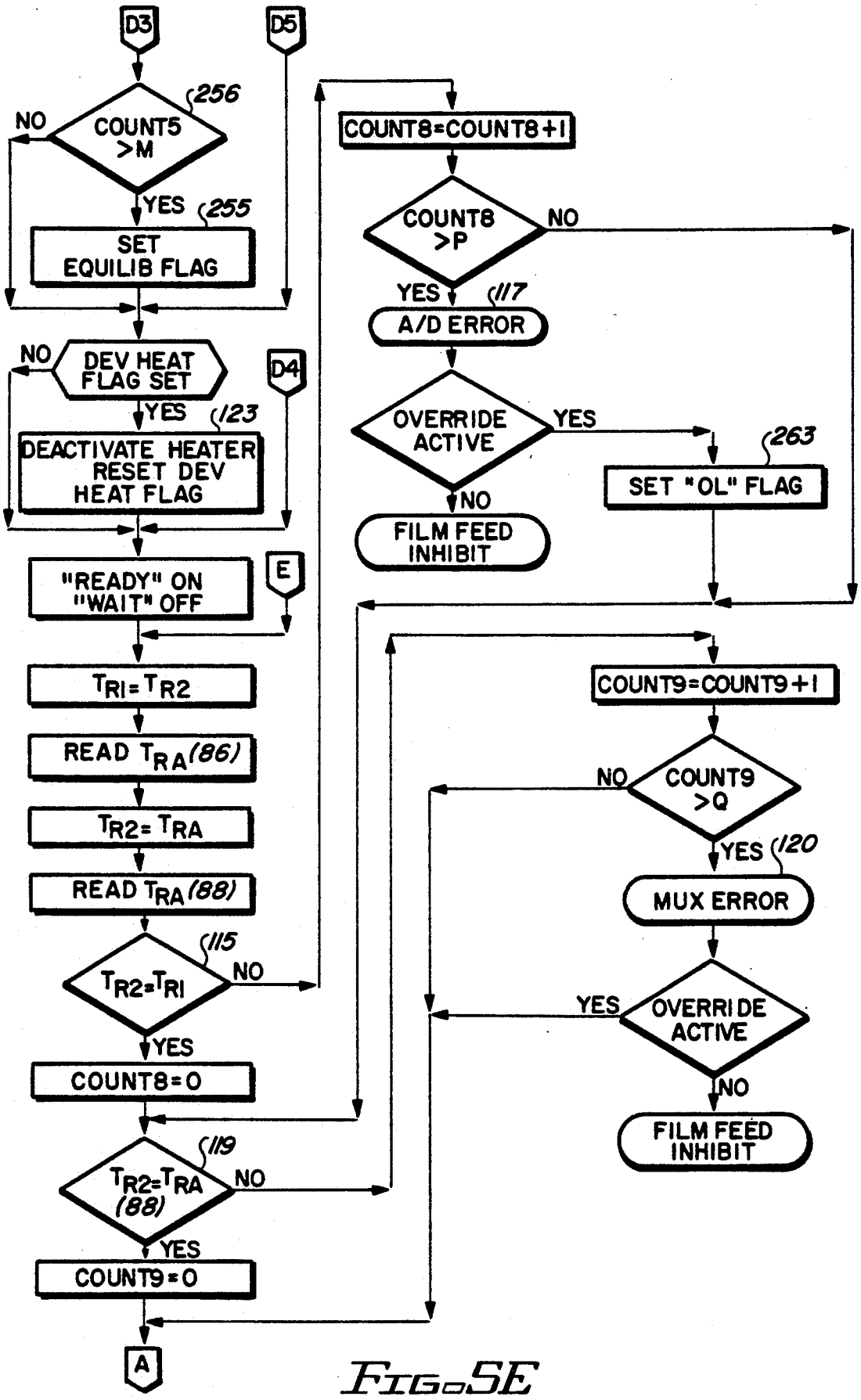

FIG. 4 illustrates a control system usable in implementing an embodiment of the present invention. As shown, a microprocessor 60 is connected to direct the operation of the processor 12. Microprocessor 60 receives input from the user through a mode switch 61 as to what processor mode of operation is desired. The system can be configured to enable the user to select among predesignated modes, such as "Kwik" or "K/RA," "Rapid," "Standard," or "Extended" modes, each having predetermined associated film path speed and chemistry temperature parameters prestored in a memory 62. The system can also be configured to permit a user to input a desired path speed and temperature directly into memory 62.

One way to implement mode switch 61 is by means of an alphanumeric keypad associated with display 38 (FIG. 1) for providing programming communication between the user and the microprocessor 60. For example, a function code can be entered to signal that mode selection is being made, followed by a selection code to designate the selected mode. Alternatively, a function code can be entered for film path speed or chemistry temperature, followed by entry of a selected speed or temperature setting. Another way to implement switch 61 is by means of a plurality of push button or toggle switches, respectively dedicated one for each selectable mode, and which are selectively actuated by the user in accordance with user needs.

Microprocessor 60 is connected to receive input information from the film width sensor 26, the entrance roller sensor 27, the developer, fixer and dryer temperature sensors 35, 45, 52, the developer and fixer level sensors 50, 51, and from various other sensors and feedback controls. The sensors 26, 27 provide the microprocessor 60 with information on the leading and trailing edge occurrences and the width of film F. This can be used together with film speed from a sensor 63 (FIG. 4) which measures the speed of shaft 65 of motor 67 used to drive the rollers 17 (FIG. 2), to give a cumulative processed film area total that guides the control of chemistry replenishment. The entrance roller sensor 27 signals when a leading edge of film F has been picked up by the roller path 16. This information can be used together with film speed and known length of the total path 16 to indicate when film F is present along the path 16.

As shown in FIG. 4, microprocessor 60 is connected to heater control circuitry 68, 69, cooling control circuitry 70, replenishment control circuitry 72, 73, dryer control circuitry 74, drive motor control circuitry 75 and annunciator control circuitry 77. Heater control circuitry 68, 69 is connected to heaters 34, 44, and cooling control circuitry 70 is connected to valves 36, 39 (FIGS. 3 and 4), to control the temperature of the developer and fixer flowing in the recirculation paths 30, 40 (FIG. 3) and, thus, the temperature of the developer and fixer in tanks 21, 22. Replenishment control circuitry 72, 73 is connected to valves 53, 56 to control the replenishment of developer and fixer in tanks 21, 22. Dryer control circuitry 74 is connected to dryer blower motor 48 and air heater 49 to control the temperature of air in dryer 24. Drive motor control circuitry 75 is connected to motor 67 to control the speed of rotation of drive shaft 65 and, thus, of rollers 17. This regulates the speed of travel of film F along film path 16 and, thus, determines the length of time film F spends at each of the stations (i.e., controls development, fixer, wash and dry times). Annunciator control circuitry 77 is connected to control the on/off cycles of annunciators in the form of a "Wait" light 78, a "Ready" light 79, and an audible alarm or buzzer 80.

The invention takes into account that, under normal functioning of heating (or cooling) cycles, the heat gain (or loss) per unit time Q experienced by the developer or fixer solutions will follow general principles of thermodynamics, as follows:

Q=(rate of energy influx to the solution)−(rate of energy influx from the solution).

Thus, for a given mass m of solution having a specific heat $C_p$, the amount of heat per unit time needed to raise the temperature of the solution by an increment $\Delta T$ can be expressed as:

$$Q=mC_p\Delta T.$$

A heat gain (or loss) per unit time applied for a time increment $\Delta t$ to the same solution can thus be expressed as:

$$Q\Delta t=mC_p\Delta T.$$

So, applying a known heat rate Q for a time $\Delta t$ to a known mass m of solution having an initial temperature $T_1$ should, under normal circumstances, result in a new temperature $T_2$, defined by:

$$T_2 = T_1 + \frac{\Delta t}{p}$$

Mathematical modeling of the thermal system of an automatic processor such as the processor 12 is described in "Ambient Water Thermal Control System" by Kenneth W. Oemcke, Department of Mechanical Engineering, Rochester Institute of Technology, Rochester, New York, July 1978. Applying such techniques to the developer and fixer recirculation paths 30, 40 of FIG. 3, yields the following expressions for normal operation of heating (or cooling) cycles for developer and fixer in processor 12:

$$T_{D2} = T_{D1} + \frac{Q_D(t_{D2} - t_{D1})}{m_D C_{PD}};$$

and $$T_{F2} = T_{F1} + \frac{Q_F(t_{F2} - t_{F1})}{m_F C_{PF}};$$

expressed in terms of developer and fixer temperatures $T_{D2}$, $T_{F2}$, and $T_{D1}$, $T_{F1}$ taken at times $t_{D2}$, $t_{F2}$ and $t_{D1}$, $t_{F1}$; and flow rates $m_D$, $m_F$ of developer and fixer through the thermowells 33, 43, respectively. The replenishment cycles function to keep the mass of solution flowing in the paths 30, 40 constant for a particular operating mode.

If an ending temperature $T_{D2}$ or $T_{F2}$ is achieved under normal closed loop operation applying a given heater (or cooler) duty cycle profile over a time period $t_{D2}-t_{D1}$ or $t_{F2}-t_{F1}$ to developer or fixer chemical having an initial temperature $T_{D1}$ or $T_{F1}$, applying the same duty cycle profile for the same period of time in open loop mode should give the same ending temperature $T_{D2}$ or $T_{F2}$. Thus, by preestablishing historical actual temperature/time data or duty cycle profiles, an ending temperature $T_{D2}$ or $T_{F2}$, within a tolerance $\pm W°$, can be obtained even in the absence of valid current actual temperature measurement data, given a starting temperature $T_{D1}$ or $T_{F1}$. The starting temperature can be obtained either from the last valid actual temperature reading automatically made, or based on operator input of a current temperature reading manually made.

The operation of the control system 10 in accordance with the invention is described with reference to FIG. 5 for the control of temperature in developer tank 21. Control of the temperature of fixer in tank 22 or air in dryer 24 can be done similarly, if desired.

When power is applied at start-up, or processor 12 is reset to a different mode (100 in FIG. 5), the system is initialized and system variables, including film speed and setpoint temperatures, are set (102). The wash water solenoid 39 is energized, allowing water to flow into the tank 23; and the developer and fixer solution levels are checked by reading sensors 50, 51 (103). If the levels are low, replenishment cycles are activated, as necessary, energizing pumps 53, 56 to fill the tanks 21, 22 (104, 106). If the levels do not reach their preset target levels within a predetermined time (e.g., count 1=I=4 minutes), a tank fill error occurs (107, 108). In the absence of activation by the user of an override (109), the fill error signal will sound a buzzer 80 (FIG. 4), disable the drive motor 67 (FIG. 4), or otherwise inhibit the feeding of fresh film F (110) until the error is cleared. If the correct levels are reached, pumps 53, 56 are deenergized (112) and recirculation pumps 31, 41 are energized to flow the solutions along the recirculation paths 30, 40 (114).

Figure 6:
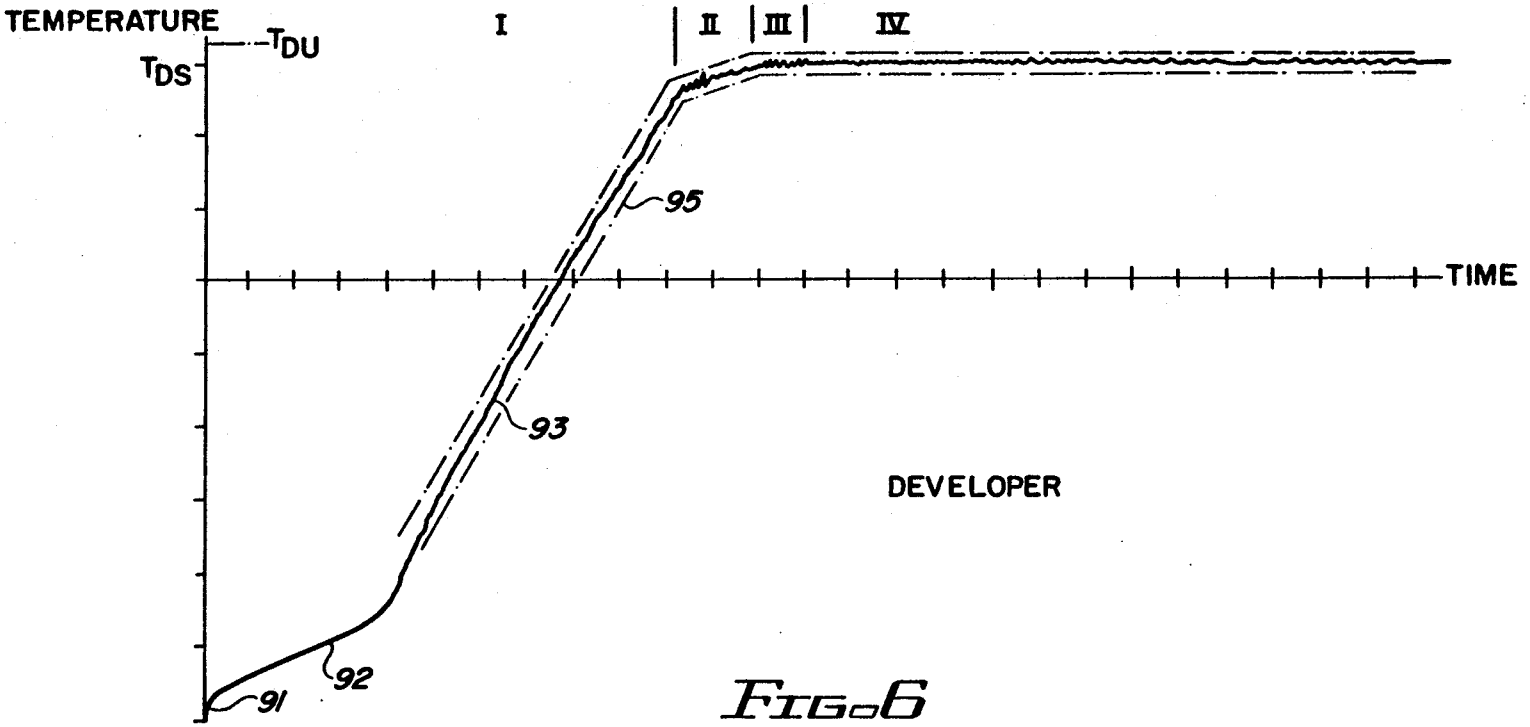
FIGS. 6 and 7 are graphical representations, respectively, of temperature time variations and heater/cooler duty cycle profiles during normal processor operation for typical developer and fixer chemical solutions.
Figure 7:
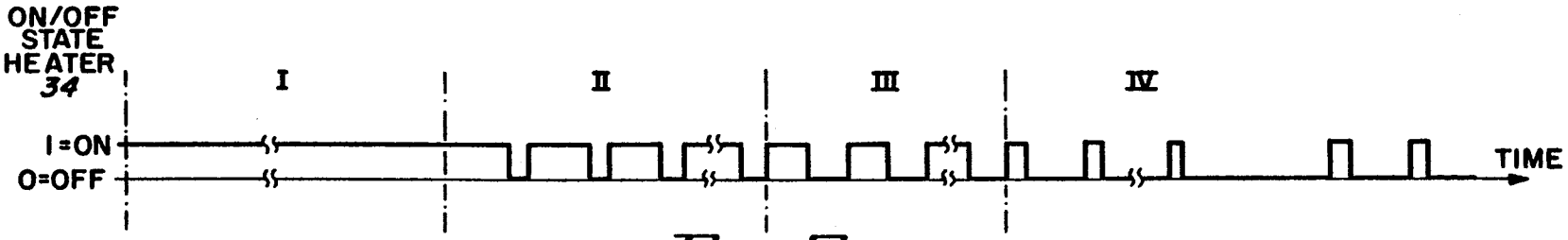

Microcomputer 60 uses algorithms and controls to monitor the temperatures of the developer, fixer and dryer air based on signals received from the sensors 35, 45, 52. The temperatures of developer and fixer within the paths 30, 40 should increase at normal rates following an initial warm-up period of several minutes after start-up or reset. FIG. 6 illustrates a typical relationship between temperature and time for the developer chemical for normal heating (and cooling) cycles from system start-up through successful attainment of setpoint temperature. FIG. 7 illustrates a typical on-off duty cycle profile for the developer heater 34 for the same period.

The developer, fixer and dryer thermistors 35, 45, 52 may suitably be connected for shared component processing, to multiplexer circuitry 86 and an analog-to-digital (A/D) converter 87 (FIG. 4). The multiplexer circuitry 86 sets the channel and voltage range for the A/D converter 87. The microprocessor 60 checks for two different errors with the thermistors: wrong A/D temperature conversions, and opened or shorted thermistors. The temperature conversions are monitored through a precision resistor 89, which is read at periodic intervals to verify the accuracy of the A/D conversion. If the value of resistor 89 is not correct for a predefined number of consecutive readings, the A/D converter 87 is considered faulty (115, 117). An opened or shorted thermistor is determined by reading an internal A/D in the microprocessor 60 (line 88 in FIG. 4) at the same time as the control A/D converter 87 for the developer, fixer and dryer sensor channels. If the readings on the internal A/D fall outside of the allowed range for a predefined number of consecutive readings, the thermistor is considered faulty. An error in the multiplexer circuit can be detected by comparing readings of the resistor 89 taken using the external A/D converter 87 and using the internal A/D converter 88 (119, 120). These checks are not performed until a time delay period of e.g., three minutes, has elapsed after power-up. This delay prevents open thermistor errors due to cold solution temperatures or cold ambient.

Developer Temperature Control

While the developer is recirculating (114), thermistor 35 in the thermowell 33 monitors actual developer temperature $T_{DA}$ at time $t_D$ (116). The resistance of the thermistor 35 changes inversely with the temperature of the solution. This data is sent to the microprocessor 60, which controls the heating and cooling systems.

The actual developer temperature $T_{DA}$ is determined by performing an analog-to-digital (A/D) conversion on the resistance of the thermistor 35. This data is then converted to a temperature of °C. or °F. by means of a software algorithm. The temperature is then compared to the setpoint temperature $T_{DS}$ previously stored in memory 62 to determine if heating or cooling is required (118). The temperature is read periodically at intervals of $\Delta t$, e.g., every ½ or ¾ second.

Optimum processing quality occurs when the developer temperature is maintained substantially at its setpoint temperature $T_{DS}$. A tolerance of ±X°, determined by user input or default, may be allowed (118). If the developer is below setpoint $T_{DS}$, the heater 34, located inside the thermowell 33, is controlled to pulse on and off at a duty cycle defined by microprocessor 60 based on the temperature data received from the thermistor 35 (121, 122).

The heating of the developer is controlled by a proportional method. Heater 34 is turned on full until the temperature $T_{DA}$ measured by sensor 35 is within 0.5° of the preestablished setpoint $T_{DS}$. This is shown by region I in FIGS. 6 and 7. Region I is characterized in FIG. 6 by an initial portion 91 having a steep rise due to the effect of heater 34 of developer in thermowell 33 prior to recirculation; a second, reduced slope portion 92 which is influenced by the cooling effect of introduced replenishment solution and heat losses due to residual ambient cooling; and, finally, a third region 93, starting about 4 minutes into the cycle, marked by an almost linear rise of net heat gain due to the heater 34 over system and ambient heat losses. Heater 34 then operates on a duty cycle of 75% over a region II shown in FIGS. 6 and 7, until the temperature $T_{DA}$ measured by sensor 35 comes within 0.3° of the setpoint $T_{DS}$. Heater 34 then operates on a duty cycle of 50% over a region III (FIGS. 6 and 7), until the temperature $T_{DA}$ is within 0.1° of the setpoint $T_{DS}$. And, finally, heater 34 operates on a duty cycle of 25% in a steady state region IV (FIGS. 6 and 7), until the setpoint temperature $T_{DS}$ is reached. When the setpoint temperature $T_{DS}$ is reached, the developer heater shuts off (123).

If the developer temperature $T_{DA}$ sensed by the sensor 35 is 0.3° or more than the setpoint $T_{DS}$ for J=5 consecutive readings, a cooling cycle is activated. If not already energized, the wash water solenoid 39 is activated to flow water in the tank 23 around the heat exchanger loop 37 (124, 125). The developer cooling solenoid 36 is then energized (126), allowing developer in the recirculating path 30 to circulate through the loop 37. The cooler water in the tank 23 surrounding the heat exchanger 37 acts to cool the developer. The cooler developer then returns to the main recirculation path 30 and back to the tank 23. The cooling cycle continues until the developer temperature $T_{DA}$ drops to 0.1° below the setpoint $T_{DS}$ for one reading of the developer thermistor 35 (127). The developer cooling solenoid 36 then deenergizes, shutting off the developer supply to the heat exchanger 37 (128). If pump 39 was not already energized when the cooling cycle began, it too is shut off (129, 130). For most effective functioning of the developer cooling system, the temperature of water flowing in the wash tank 23 should preferably be at a temperature 10° F. (6° C.) or more below the operating setpoint $T_{DS}$ of the developer temperature.

The developer heating and cooling systems are responsible for maintaining the developer at the current processing mode temperature setpoint $T_{DS}$ under all operating conditions. The developer solution should stabilize at the setpoint temperature $T_{DS}$ within 15–20 minutes after start-up, and within 5 minutes after a mode change.

Measured temperatures are examined to determine whether the measured actual temperature $T_{DA}$ exceeds a prespecified maximum developer temperature limit $T_{DUL}$ (145, 146). If it does, an overtemperature error occurs. If the rate of change for the developer temperature is not within the tolerance of normally expected rate of change, the processor will display an error message (142, 143). For each heating or cooling cycle, the rate of change in developer temperature $R_{DA} = (T_{D2} - T_{D1})/(t_{D2} - t_{D1})$ that actually occurs (201) is compared with a predetermined acceptable change in developer temperature $R_{DS}$ ($R_{DH}$ or $R_{DC}$) that should occur if that heating or cooling cycle is functioning normally. If the difference between the predicted change and the actual change exceeds a preestablished tolerance ±Y° per second, a rate error is flagged. A "loss of developer heating ability" or "loss of developer cooling ability" error is displayed. These errors are cleared when either the rate corrects itself or the setpoint temperature $T_{DS}$ is reached (118). Should the error persist and not correct itself, a buzzer signal, drive transport lockout or other fresh film feed inhibit routine can be invoked, subject to a user selectable override.

If thermistor 35 is open- or short-circuited, or the temperature control A/D converter is not operating correctly, an "unable to determine developer temperature" error message will be displayed (148, 149). This error will not normally be cleared unless the processor is deenergized and then energized again.

The cooling rate is checked as long as cooling is needed. The heat rate is checked when the developer is on full; the temperature of the solution is above 84° F. (29° C.); and the replenish pumps are off. For the depicted embodiment, the minimum heating rate $R_{DH}$ (139) calls for an increase of 2.0° every 2 minutes; and the minimum cooling rate $R_{DC}$ (140) calls for a decrease of 0.1° every 3 minutes.

Electrical noise or similar transients experienced by the electrical control system 10 can lead to random occurrences of invalid temperature measurements $T_{DA}$ (116). Comparisons of erroneous values of $T_{DA}$ with setpoint temperature $T_{DS}$ for heating or cooling cycle control purposes (118, 127), can lead to unintended heating or cooling cycle activations or deactivations. Such unintended activity may upset the temperature balance of the system, requiring otherwise unnecessary additional corrective heating or cooling operations. Furthermore, comparisons of erroneous values of $T_{DA}$ with preestablished allowable temperature limits $T_{DUL}$ (145), or of rates $R_{DA}$ based on erroneous values of $T_{DA}$ with predetermined acceptable rates $R_{DH}$, $D_{DC}$ (139, 140), can lead to false error designations (146, 142, 143), leading to unintended interference with normal processing.

In accordance with the measured temperature validity confirmation procedure of U.S. patent application Ser. No. 07/759,484, the validity of the temperature $T_{DA}$ of developer measured at a time $t_D$ is verified to determine its correspondence with a temperature $T_{DP}$ predicted for the developer for the same time $t_D$, given a known starting temperature $T_{D1}$ at time $t_{D1}$ and known heat gain (or loss) relationships applicable for the heating or cooling cycle to which the developer is subjected during the time interval from $t_{D1}$ to $t_D$. Because the developer temperature changes relatively slowly, the temperature state of the developer can only change by a certain amount in any given time interval for any given heating or cooling cycle. Thus, a measured temperature $T_{DA}$ that deviates from the predicted value $T_{DP}$ by more than a preestablished tolerance $\pm Z°$ corresponds to a developer temperature state which cannot exist and is, thus, invalid. Random occurrences of erroneous data $T_{DA}$ indicative of isolated measurements of non-valid temperature states are identified and disregarded for control and error diagnosis purposes.

In the temperature validating process, the actual temperature $T_{DA}$ of developer at time $t_D$ is read (116). The values of $T_{D2}$, $t_{D2}$ are then set to $T_{DA}$, $t_D$ (200), and an actual change rate $R_{DA}$ is calculated (201). However, before the measured actual temperature $T_{DA}$ or rate $R_{DA}$ are used in control or error determination comparisons (148, 145, 118, 127, 139, 140), a data validating procedure is undertaken between the steps 116 and 200 of FIG. 5.

The verification process is implemented so that it takes place only after a preset time (determined by count 6=T minutes) has elapsed since start-up or mode change (202–203 and 204–207, FIG. 5). A predicted temperature $T_{DP}$ at time $t_D = t_{D2}$ is determined (210) based on an applicable heat gain (loss) factor $Q_D$ chosen in accordance with whether a heating cycle, cooling cycle or neither is active (212–216). The measured actual temperature $T_{DA} = T_{D2}$ at time $t_{D2}$ is then compared with the determined predicted temperature $T_{DP}$ at the same time $t_{D2}$ (218). If the measured actual temperature $T_{D2}$ is within acceptable tolerance $\pm Z°$ of the predicted temperature $T_{DP}$, its validity is affirmed, and that data is utilized in the control and error diagnosis comparisons (148, 145, 118, 127, 139, 140). However, if the measured temperature $T_{D2}$ is outside the acceptable tolerance $\pm Z°$, control and error diagnosis comparisons are circumvented until a valid $T_{DA}$ is encountered (218, 220).

If values of measured actual temperature $T_{DA}$ continue to deviate beyond acceptable limits from predicted values, indicating that the error is not random (i.e. occurs more than count 7=R times in a row) (221–222), an error is signalled (224) to show that non-valid temperature states are being continuously indicated.

The effect of implementation of an invalid data detection and elimination procedure in the developer temperature control process, as described, is to provide a guardband 95 (shown in dot-dashed lines in FIG. 6) about the plot of developer temperature vs. time. Any isolated data point occurring outside of the guardband 95 will be disregarded for temperature control and error diagnosis purposes.

Errors in A/D conversions (117), opened or shorted thermistors (149), continuing out-of-rate errors (142, 143), and persistent non-valid state errors (224) are all indicative of a failure of the ability of the system 10 to be able to continue to generate current valid actual developer temperature measurement data $T_{DA}$ usable for real time feedback control purposes. In accordance with the invention, a mechanism is provided to selectively override a lockout or system shutdown that occurs when this happens, and enable temperature control to be continued at the option of the user, on an open loop basis using historical temperature measurement data or on-off duty cycle information.

As shown in FIG. 5, one implementation of the invention provides for storage of the succession of measured temperature values $T_{DA}$, $t_D$ in memory 62, following verification of their validity (see step 250 in FIG. 5). $T_{D2}$, $t_{D2}$ are not assigned the values of $T_{DA}$, $t_D$ in step 200, unless data validity is verified. This ensures that only validity-verified data will be utilized to develop a stored actual temperature/time measurement profile. The use of an actual historical profile rather than a calculated theoretical profile ensures that variables, such as room temperature, water temperature, etc., which may fluctuate from site-to-site and time-to-time, are taken into account. The microprocessor 60 may be instructed to update the historical profile at predesignated times during normal closed loop system operation, such as at start-up and each time a mode change occurs. The implementation depicted in FIG. 5 provides updating for each start-up or mode change (100) by the setting of an update flag (251, 252). Updating continues for a period defined by count 10=N (253). Profiles from previous start-ups or mode changes can be kept for accuracy verification purposes, depending on available memory space. Also, once setpoint temperature is reached for a particular mode (118, 255), and sufficient time (count 5 =M) has elapsed for the developer to have reached an equilibrium state (256), a historical profile of the region IV heating (cooling) duty cycle information (on-off status vs. time, FIG. 7) can be stored for future reference (257, 258). Appropriate updating times can be set as for the storage of measurement data profiles (251, 252). Then, should valid current temperature measurement data $T_{DA}$, $t_D$ become unavailable for real time feedback control purposes because of a continuing error (117, 142, 143, 149, 224), the stored historical measured temperature data or duty cycle profile can be called upon to supply temperature control on an open loop basis.

For the implementation shown in FIG. 5, user activation of an override condition in the absence of reliable measurement data $T_{DA}$, $t_D$ sets an open loop control flag "OL" (260, 261, 262, 263, 264). If this occurs before equilibrium has been reached (i.e., before the equilibrium flag has been set at 255), system control will continue as before, except that historical profile data $T_{DA}'$, $t_D'$ (250) will be used for decision making purposes, rather than current actual temperature information (266, 267, 268). The initial starting temperature $T_{D1}$ of the solution will be determined based on the last valid data available, or based on user input in response to a query (270, 271, 272). Stored historical data for regions I, II and III of the curve shown in FIG. 6 will, thus, serve to bring the temperature of the developer to its equilibrium state. Once the equilibrium state is reached (255, 267), the historical profile of the duty cycle will be used to maintain the system of equilibrium (266, 267, 275).

The undue influence of a cold slug of replenishment developer passing through the thermowell 33 prior to mixing with the warmer fluid already in the developer tank 21, can be accommodated according to the procedure set forth in U.S. patent application Ser. No. 07/759,454, entitled "Modification of Film Processor Chemistry Proportional Heating During Replenishment," filed on even date herewith, the disclosure of which is incorporated herein by reference. The principles of that procedure can be implemented here, also to prevent the storing of data $T_{D2}'$, $t_{D2}'$ (250) which is distorted by sensing the temperature of the unmixed slug.

Fixer Temperature Control

The replenishment and temperature control cycles associated with the fixer tank 22 are similar to those associated with the developer tank 21 and can be implemented to provide for open loop control in the like fashion. Tank 22 is both filled and replenished automatically from a connection 57 to a supply of fresh fixer solution. Like the developer, when tank 22 is full, fixer is recirculated continuously by a recirculation pump 41 through a thermowell 43 where a thermistor 45 monitors the temperature of the solution.

When the fixer solution is circulating in path 40, a heater 44 in the thermowell 43 maintains the temperature of the solution to increase its effectiveness. This is especially important to support the faster processing modes. The duty cycle of the fixer heater 44 is not regulated like that of the developer heater 34. The fixer temperature $T_{FA}$ is determined by performing an analog-to-digital (A/D) conversion on the resistance of the thermistor 45 using the same multiplexer circuitry 86, A/D converter 87, and internal A/D converter 88 as for the developer. This data is then converted to a temperature in °F. or °C. by microprocessor 60 by means of a software algorithm. The temperature is then compared to the setpoint $T_{FS}$ stored in memory 62 to determine if heating is required.

The fixer, which operates more effectively at higher temperatures, does not have to be cooled. The fixer heater 45 operates at full capacity when the fixer is below the setpoint $T_{FS}$. When the temperature $T_{FA}$ is above the setpoint, the heater is turned off. Like the developer, the fixer solution should stabilize at the setpoint temperature $T_{FS}$ within 15–20 minutes after start-up, and within 5 minutes after a mode change.

As with the developer, the rate at which the fixer is heated can be checked according to the out-of-rate error checking procedure set forth in U.S. patent application Ser. No. 07/738,664. If the rate of change $R_{FA}$ for the fixer temperature $T_{FA}$ is not within normal anticipations, the processor 12 will display a "loss of fixer heating ability" error message. A suitable minimum acceptable heating rate for the depicted embodiment is an increase of 2.0° every 2 minutes. This error is cleared when either the rate corrects itself or, unless the film feed inhibit function is active, the fixer setpoint temperature $T_{FS}$ is reached. The fixer heat rate error is checked when the fixer is on full; the temperature is above 84° F. (29° C.); and the replenish pumps are off.

If the thermistor 45 is opened or shorted, or the temperature control A/D is not working, an "unable to determine fixer temperature" error will be displayed. An "overtemperature" error will occur if the fixer temperature $F_{FA}$ exceeds a preestablished maximum allowable upper limit $T_{FUL}$. These errors are normally not cleared unless the processor 12 is deenergized and then energized again.

Also, as for the developer, in accordance with U.S. patent application Ser. No. 07/759,484, the fixer temperature control process can provide for invalid data detection. The actual temperature $T_{FA}$ of fixer at time $t_F$ is read. A predicted temperature $T_{FP}$ at time $t_F=t_{F2}$ is determined based on an applicable heat gain factor $Q_F$ chosen in accordance with whether a heating cycle is active, or not. The measured actual temperature $T_{FA}=T_{F2}$ at time $t_{F2}$ is then compared with the determined predicted temperature $T_{FP}$ at the same time $t_{F2}$.

If the measured actual temperature $T_{F2}$ is within acceptable tolerance of the predicted temperature $T_{FP}$, its validity is affirmed, and that data is utilized in the control and error diagnosis comparisons. However, if the measured temperature $T_{F2}$ is outside the acceptable tolerance, control and error diagnosis comparisons are circumvented until a valid $T_{FA}$ is encountered. If values of measured actual temperature $T_{FA}$ continue to deviate beyond acceptable limits from predicted values, an error is signalled to show that non-valid fixer temperature states are being continuously indicated.

Historical profiles of actual fixer temperature/time measurements and fixer heater on-off duty cycles at equilibrium can be stored and updated in the same manner as done for the corresponding measurement data and duty cycle information for the developer. When an "unable to furnish valid data" error occurs, fixer temperature control can be implemented just like developer temperature control to work on a user-selected, open loop override basis.

Dryer Air Temperature Control

The same principles are also applicable to dryer air control. As film F is transported through the dryer 24, air tubes 25 circulate hot air across the film F. The tubes 25 are located on both sides of the dryer 24 to dry both sides of the film at the same time. The dryer heater 49 heats the air to a setpoint temperature $T_{AS}$ within the range of 90°-155.F° F. (38°-65.5° C.) as set by the user or mode default parameters. The actual temperature $T_{AA}$ in the dryer is sensed by a thermistor 52 using the same multiplexer and A/D circuits 86, 87.

The air temperature $T_{AA}$ is determined by converting the resistance of thermistor 52 into ° F. or ° C. This value is then compared to the setpoint $T_{AS}$. If the temperature $T_{AA}$ is below the setpoint $T_{AS}$, the dryer blower 48 and dryer heater 49 are turned on. The blower 48 activates first, with the heater 49 following (this prevents damage to the heater) in response to activation of the vane switch 82 by the blower air. The heater 49 operates at full capacity. When the temperature $T_{AA}$ is above the setpoint $T_{AS}$, the dryer heater 49 is turned off. The actual rate $R_{AA}$ at which the air in the dryer is heated is checked. For the depicted embodiment, the minimum acceptable heating rate is an increase of 0.5° every 2 minutes. If the rate is not correct, an "inoperative dryer" error is displayed. The heat rate error is checked when the dryer heater is operating; film is not present in the processor; and after initialization is completed at power-up. If the dryer temperature $T_{AA}$ exceeds the maximum temperature value $T_{AUL}$ of the A/D converter (approximately 167° F.), an overtemperature condition exists. A "dryer overtemperature" data error will be displayed and the processor will shut down after the last film exits. If the thermistor 52 is opened or shorted, or the temperature control A/D converter 87 is not operating correctly, an "unable to determine dryer temperature" error message is displayed. This error normally remains unless the processor is deenergized and then energized again. If the dryer setpoint temperature $T_{AS}$ is changed to a higher value, a "dryer underset temp warning" is displayed until the new setpoint is reached.

As for the developer and fixer temperature control processes, the dryer air temperature control process can provide for detection and disregard of invalid data. Actual temperature $T_{AA}$ at time $t_A$ is read. A predicted temperature $T_{AP}$ at time $t_A = t_{A2}$ is determined based on an applicable heat gain factor $Q_A$ chosen in accordance with whether a heating cycle is active, or not. The measured actual temperature $T_{AA} = T_{A2}$ at time $t_{A2}$ is then compared with the determined predicted temperature $T_{AP}$ at the same time $t_{A2}$. If the measured actual temperature $T_{A2}$ is within acceptable tolerance of the predicted temperature $T_{AP}$, its validity is affirmed, and that data is utilized in the control and error diagnosis comparisons. However, if the measured temperature $T_{A2}$ is outside the acceptable tolerance, control and error diagnosis comparisons are circumvented until a valid $T_{AA}$ is encountered). If values of the measured actual temperature $T_{AA}$ continue to be invalid, an error is signalled to show that non-valid dryer air temperature states continue.

Provision can be made in accordance with the invention to store historical perspectives of dryer measured temperature/time data and/or duty cycles, and use the same in response to user-selected override, to control dryer air temperature on an open loop basis when usable current temperature data is not available.

As film F leaves the dryer 28, it passes through the exit opening 19 where it is transported out of the interior of the processor 12 and into the top receiving tray 18. If no new film F enters the processor, the processor will enter a standby mode approximately 15 seconds after a film has exited. In the standby mode the water supply is turned off, unless needed for developer cooling; the developer, fixer and dryer temperatures are maintained at their setpoints $T_{DS}$, $T_{FS}$ and $T_{AS}$; and the drive motor 67 is changed to standby operation.

Those skilled in the art to which the invention relates will appreciate that other substitutions and modifications can be made to the described embodiment without departing from the spirit and scope of the invention as described by the claims below.

What is claimed is:

1. A method for controlling temperature of developer, fixer or dryer air fluid in the processing of exposed photosensitive media utilizing apparatus having means for automatically transporting said media from a feed point along a path through developer, fixer, wash and dryer air stations, a sensor for sensing the temperature of the fluid whose temperature is being controlled, and means for changing the temperature of said fluid; said method including the steps of:

establishing a reference temperature $T_S$ of said fluid;

generating current data corresponding to a series of measured actual temperatures $T_A$ of said fluid station at particular respective current times t, using said fluid temperature sensor; and normally regulating the temperature of said fluid in accordance with said reference temperature $T_S$ and in response to said generated current data, using said fluid temperature changing means;

and said method being characterized in that:

said method further comprises automatically storing historical data corresponding to a time history of said generated current data;

determining when valid generated current data corresponding to actual temperatures $T_A$ at times t is not available; and in response to said nonavailability determination, regulating the temperature of said fluid in accordance with said reference temperature $T_{DS}$ and in response to said stored historical data, rather than in response to said generated current data.

2. A method as in claim 1, wherein said storing step comprises sequentially storing ones of said series of actual measured temperatures $T_A$.

3. A method as in claim 2, wherein said method further comprises confirming the validity of said measured actual temperatures $T_A$ against possible temperature states; and said storing step comprises storing only validity confirmed ones of said series.

4. A method as in claim 2, wherein said storing step comprises sequentially storing ones of said series of actual measured temperatures $T_A$ occurring prior to said fluid reaching an equilibrium state at said reference temperature $T_S$, and storing a time history of an on-off duty cycle of said temperature changing means subsequent to said fluid reaching said equilibrium state.

5. A method as in claim 4, wherein said step of regulating in response to said nonavailability determination comprises regulating the temperature of said fluid in response to said stored ones of said series prior to said fluid reaching said equilibrium state, and regulating the temperature of said fluid in response to said stored duty cycle subsequent to said fluid reaching said equilibrium state.

6. A method as in claim 1, wherein said storing step comprises storing a time history of an on-off duty cycle of said temperature changing means.

7. A method as in claim 1, wherein said method utilizes apparatus having multiple modes of operation; and said method further comprises updating said stored historical data after each mode change of said apparatus.

8. A method as in claim 1, wherein said step of regulating in response to said nonavailability determination further comprises regulating the temperature of said fluid on the basis of a starting temperature set equal to the last current data generated prior to determining said nonavailability.

9. A method as in claim 1, wherein said method further comprises input of a measured actual temperature $T_U$ of said fluid; and said step of regulating in response to said nonavailability determination further comprises regulating the temperature of said fluid on the basis of a starting temperature set equal to said actual measured temperature $T_U$.

10. A method as in claim 1, wherein said apparatus has means for input of an override signal; and said method further comprises detecting the presence or absence of said override signal; normally inhibiting the further processing of said media in response to said nonavailability determination; and said step of regulating in response to said nonavailability determination occurs in response to detecting the presence of said override signal.

11. A method for controlling temperature in the processing of exposed photosensitive media utilizing apparatus having means for automatically transporting said media from a feed point along a path through developer, fixer, wash and dryer stations, a developer temperature sensor, and means for changing the temperature of said developer; said method including the steps of:

establishing a reference developer temperature $T_{DS}$;

sensing a series of actual temperatures $T_{DA}$ of developer located at said developer station at particular respective times $t_D$, using said developer temperature sensor; and normally regulating the temperature of said developer on a real time, closed loop basis, in accordance with said reference temperature $T_{DS}$ and in response to feedback of said sensed actual temperatures $T_{DA}$, using said developer temperature changing means;

and said method being characterized in that:

said method further comprises storing information corresponding to the normal regulation over time of said developer temperature using said developer temperature changing means;

determining when an absence exists of an ability to continue to reliably sense said actual temperatures $T_{DA}$ at times $t_D$; and in response to said absence determination, regulating the temperature of said developer on an open loop basis, in accordance with said reference temperature $T_{DS}$ and in response to said stored information, using said developer temperature changing means.

12. A method as in claim 11, wherein said storing step comprises sequentially storing a time history of ones of said sensed series of actual temperatures $T_{DA}$.

13. A method as in claim 11, wherein said storing step comprises storing a time history of an on-off duty cycle of said temperature changing means.

14. A method for controlling temperature in the processing of exposed photosensitive media utilizing apparatus having means for automatically transporting said media from a feed point along a path through developer, fixer, wash and dryer stations, a developer temperature sensor, and means for changing the temperature of said developer; said method including the steps of:

establishing a reference developer temperature $T_{DS}$;

sensing a series of actual temperatures $T_{DA}$ of developer located at said developer station at particular respective times $t_D$, using said developer temperature sensor; and normally regulating the temperature of said developer in accordance with said reference temperature $T_{DS}$ and in response to currently sensed ones of said sensed actual temperatures $T_{DA}$, using said developer temperature changing means;

and said method being characterized in that:

said method further comprises storing information corresponding to the regulation over time of said developer temperature using said currently sensed ones of said sensed actual temperatures $T_{DA}$;

confirming the validity of said currently sensed ones of said sensed actual temperatures $T_{DA}$ against possible developer temperature states;

in response to said sensed temperature validity confirming step, determining when an absence exists of validity confirmed currently sensed ones of said sensed actual temperatures $T_{DA}$; and in response to said absence determination, regulating the temperature of said developer in accordance with said reference temperature $T_{DS}$ and in response to said stored information, rather than in response to said currently sensed ones of said sensed actual temperatures $T_{DA}$.

15. A method as in claim 14, wherein said storing step comprises storing ones of said sensed actual temperatures $T_{DA}$, and said step of regulating in response to said absence determination comprises regulating the temperature of said developer in response to said stored ones of said sensed actual temperatures $T_{DA}$.

* * * * *